US006547161B1

(12) United States Patent
Huang

(10) Patent No.: US 6,547,161 B1
(45) Date of Patent: Apr. 15, 2003

(54) SPRAY PAINT GUN HEAD

(76) Inventor: Tiao-Hsiang Huang, No. 190, Chung Chen St., Shin Chuang City, Taipei Hsien (TW)

( * ) Notice: Subject to any disclaimer, the term of this patent is extended or adjusted under 35 U.S.C. 154(b) by 0 days.

(21) Appl. No.: 10/020,301

(22) Filed: Dec. 18, 2001

(51) Int. Cl.[7] ..... B05B 1/28
(52) U.S. Cl. ..... 239/296; 239/290
(58) Field of Search ..... 239/525, 526, 239/296, 298, 290, 297, 299

(56) References Cited

U.S. PATENT DOCUMENTS 1,990,823 A * 2/1935 Gustafsson ..... 239/8
4,236,674 A * 12/1980 Dixon ..... 239/296
4,392,617 A * 7/1983 Bakos et al. ..... 239/290
4,728,039 A * 3/1988 Johnson et al. ..... 239/296
5,165,605 A * 11/1992 Morita et al. ..... 239/296
5,803,367 A * 9/1998 Heard et al. ..... 239/296
6,085,996 A * 7/2000 Culbertson et al. ..... 239/290
6,471,144 B1 * 10/2002 Huang ..... 239/296

* cited by examiner

*Primary Examiner*—Lisa A. Douglas
(74) *Attorney, Agent, or Firm*—Rosenberg, Klein & Lee

(57) ABSTRACT

This invention relates to an improved pressure regulation structure at the tip of the spray gun connected to the nozzle. A screw hole is formed in the front section of a passage where a regulation shaft extends from the tip of the spray gun. An inner recess and an outer recess are formed on the front surface of the spray gun respectively with an air outlet. A gasket with slots is inserted between the spray gun and the nozzle. A hollow screwed tube formed in the rear of the nozzle to receive insertion of the gasket before being engaged to the screw hole of the spray gun. An inner recess and an outer recess with air ventilating holes and air outlets formed in the nozzle. A groove is formed around a nozzle tip at the front side of the nozzle. The inner and outer recesses of the nozzle abutted to the inner and outer recesses of the spray gun to form a pressure regulation air port; and outer threads provided on the nozzle to receive a nut for the spray head connected to a nut to hold against the nozzle.

1 Claim, 4 Drawing Sheets

SPRAY PAINT GUN HEAD

BACKGROUND OF THE INVENTION (a) Field of the Invention

The present invention relates to a spray paint gun head, and more particularly, to one allows easy corresponding assembly of an abutting structure that gives pressure stabilizing effect without matching error of an axial hole of insertion configuration.

(b) Description of the Prior Art

To secure consistent, evenly distributed air output, an air outlet end of a spray paint gun of the prior art is provided with a structure of pressure regulation. As illustrated in FIGS. 3 and 4 of the accompanying drawings, a spray paint gun (A) delivering air at a consistent pressure comprises a pressure regulation ring (B), a nozzle (C), a spray head (D) and a nut (E). The pressure regulation ring (B) provided at the tip of a spray gun (A) is engaged to a nozzle (C) through the pressure regulation ring (B), and the nut (E) coupled to the spray head (D) that secures the nozzle (C) to the tip of the spray gun (A). Wherein, the tip of the spray gun (A) related to a circular wall having male threads (A1) on its external surface and a circular recess (A2) therein. A screw hole (A3) is formed in the recess (A2) having a regulation shaft (F) extended from the center of a passage formed within the screw hole (A3). An air outlet (A4) is provided on the outer ring of the screw hole (A3) and another air outlet (A5) is provided on the circular wall in relation to the recess (A2). A pressure regulation ring (B) is provided that it can be inserted into the recess (A2), and a circular groove (B1) in a width properly corresponding to the diameter of the air outlet (A4) is formed on its side facing the recess (A2). Multiple through holes (B2) are provided in the circular groove (B1). Furthermore, a hollow screwed tube (C1) is formed at the rear end of the nozzle (C) to be inserted through the pressure regulation ring (B) and engaged by the screw hole (A3). Meanwhile, the body of the nozzle (C) extends into the recess (A2) to hold its rear tightly against the pressure regulation ring (B). A circular groove (C2) is formed in the nozzle (C) on its rear side facing the pressure regulation ring (B). Multiple air outlets (C3) are provided in the circular groove (C2) and penetrating through the nozzle (C) until reaching a circular channel (C5) provided around a nozzle tip (C4) at the front side of the nozzle (C). A push-pull surface (C51) is formed on the outer surface of the circular channel (5). As for the spray head (D), it is inserted to the nut (E), which in turn is engaged to the male threads (A1) provided at the tip of the spray gun (A). The spray head (D) then holds against the front of the nozzle (C) and is provided inside a circular indention (D1) with a push-pull wall (D2). The push-pull wall (D2) is abutted to the push-pull surface (C51) of the circular channel (C5) in front of the nozzle (C). Air ducts (D3) provided on the outer ring of the push-pull wall (D2) are connected two air outlet bases (D4) outside the spray head (D). A spray hole (D5) to allow insertion of the nozzle tip (C4) is provided in the center of the circular indention (D1).

During the application of the spray paint gun of the prior art, high pressure air flowing in the spray gun (A) is delivered from the air outlet (A4) in the recess (A2) on the front end of the spray gun and another air outlet (A5) on the surface of the outer ring of the screw hole (A1), then conducted into the air passage in the nozzle (C) and the spray head (D). The pressurized air leaving the air out (A4) in the recess (A2) is immediately sent into the circular groove (B1) of the pressure regulation ring (B) to become stabilized inside a port formed by the circular groove (B1) before flowing into the circular groove (C2) in the nozzle (C) to be further buffered. The buffered air in the circular groove (C2) flows to the circular channel (C5) on the front side through the air outlet (C3) to enter into the spray head (D) to be conducted into the circular indention (D1) by a closed passage formed by the push-pull surface (C51) on the circular channel (C5) abutted by the push-pull wall (D2). Furthermore, the air delivered from the surface on the external ring of the circular recess (A2) flows in a space formed on the surface of the outer ring to the push-pull wall (D2). Finally, the air in the circular indention (D1) is jetted through a gap between a spray hole (D5) and the nozzle tip (C4) to atomize the mix of coating and air flow jetted from the nozzle (C) by disturbance jointly produced with the air delivered from the air bases (D4) externally provided to the air ducts (D3).

However, in the prior art, the spray body is essentially molded in one piece of aluminum alloy with a stainless steel surface after plating and thermal treatment. The plated surface is given with a certain film thickness. As the circular recess (A2) in the front end of the spray gun relates to an open recess, it is plated at the same time with the spray body, making it difficult for precision control of its diameter. A temperature factor of thermal treatment also presents another potential variance to deformation of the circular wall of the recess (A2) to further affect the true roundness of the recess (A2). Therefore, upon inserting the regulation ring (B) into the recess (A2), abnormal resistance is encountered. The pressure regulation ring (B) is made of plastic material and is vulnerable to be deformed, if not damaged when forced in by hammering or other means, affecting the transfer of the air in the circular groove (B1) and those through holes (B2).

SUMMARY OF THE INVENTION

The primary purpose of the present invention is to provide an improved structure of a spray paint gun head with by eliminating matching error of an axial hole to help all the related elements giving their optimal performance. To achieve the purpose, the abutting structure inside the spray head of the prior art is waived, instead, an improvement made to pressure regulation structure at where the front end of the spray gun is abutted to the nozzle, essentially characterized by that:

A screw hole, formed in the front section of a passage of a spray gun wherein a pressure regulation shaft extends, connects to a nozzle. The surface of the tip of the spray gun is formed an inner and an outer circular recesses, and each recess is respectively provided with an air outlet. A gasket is inserted between the spray gun and the nozzle. Slots arranged in circular keeping a proper distance among one another are respectively provided on the gasket to match said inner and outer recesses. A hollow screwed tube is formed in the rear of the nozzle to receive the gasket before being engaged to a screw hole at the tip of the spray gun. Another inner circular and outer recesses are also formed on the rear side of the screw tube, wherein, air ventilation and air outlet are respectively provided penetrating all way to reach the front side of the nozzle. With the inner and the outer recesses of the nozzle being abutted to the slots of the gasket to fully attach to the matching inner and outer recesses on the surface of the front of the spray gun, a pressure regulation port is formed. Meanwhile, multiple male threads on the outer side of the spray body are engaged to a nut to merely for the spray head to be secured in position by holding against the nozzle.

DETAILED DESCRIPTION OF THE PREFERRED EMBODIMENTS

Figure 1:
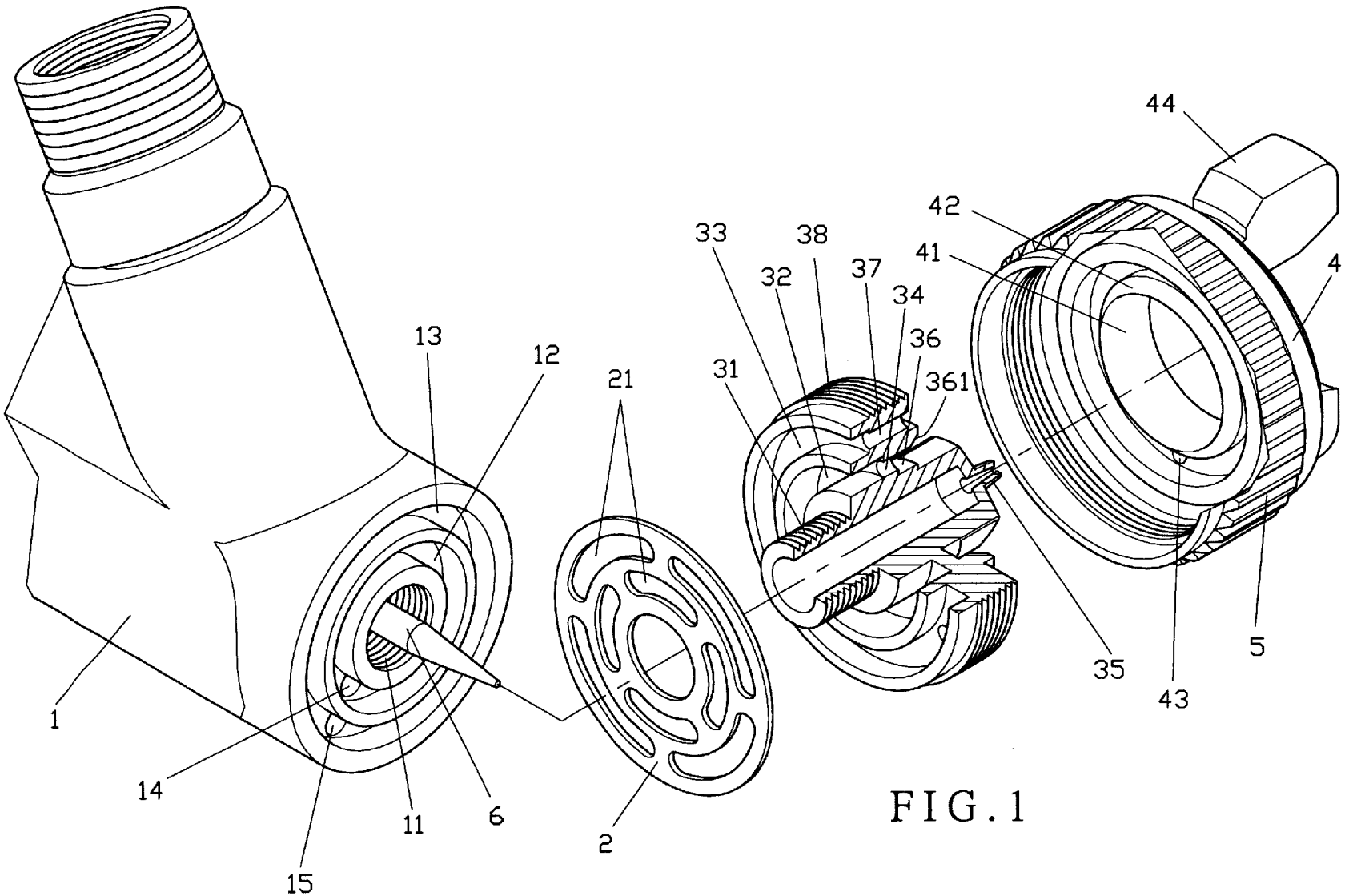
FIG. 1 is an exploded view of a preferred embodiment of the present invention.
Figure 2:
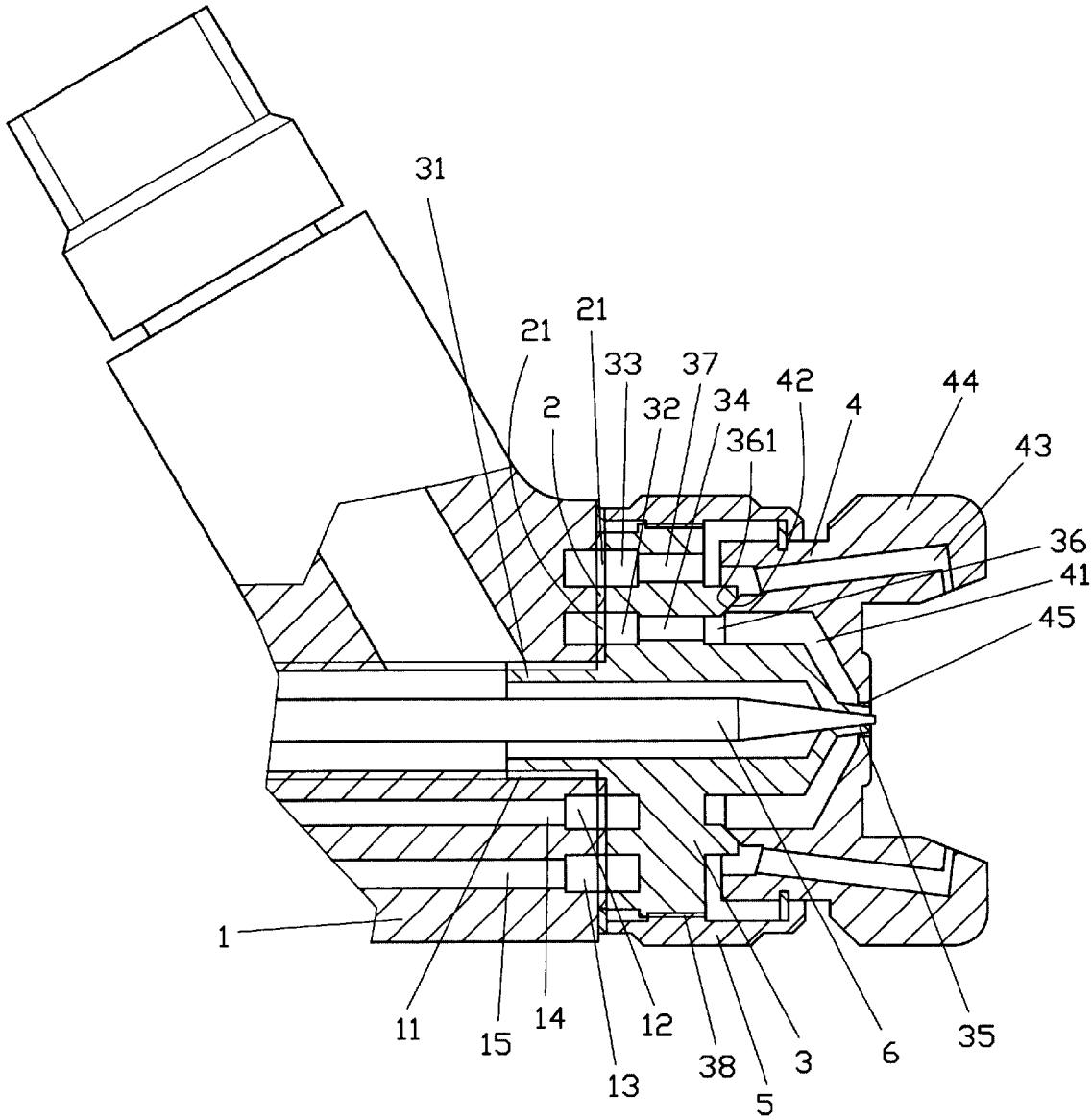
FIG. 2 is a sectional view of an assembly of the preferred embodiment of the present invention.
Figure 3:
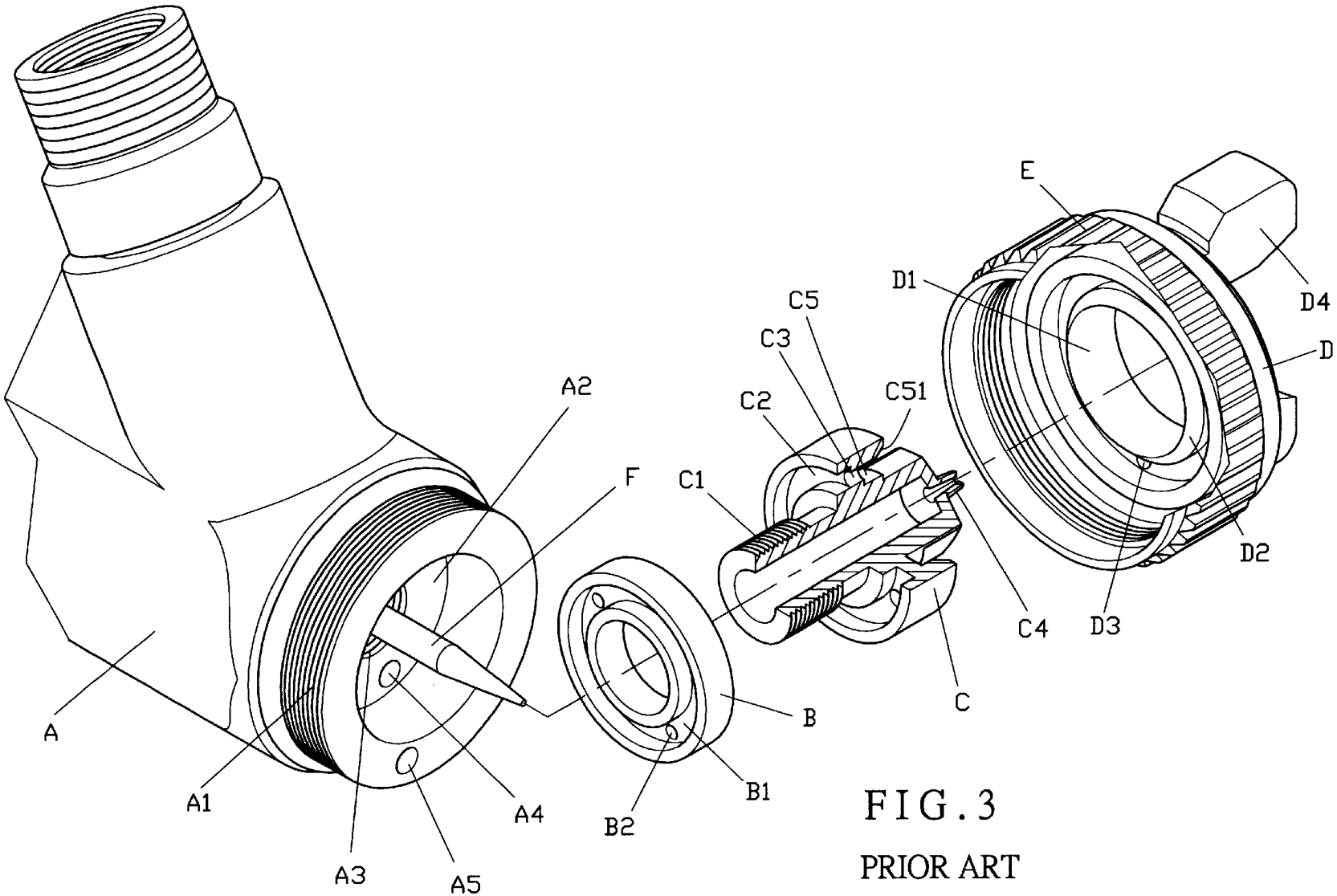
FIG. 3 PRIOR ART
FIG. 3 is an exploded view of a prior art.
Figure 4:
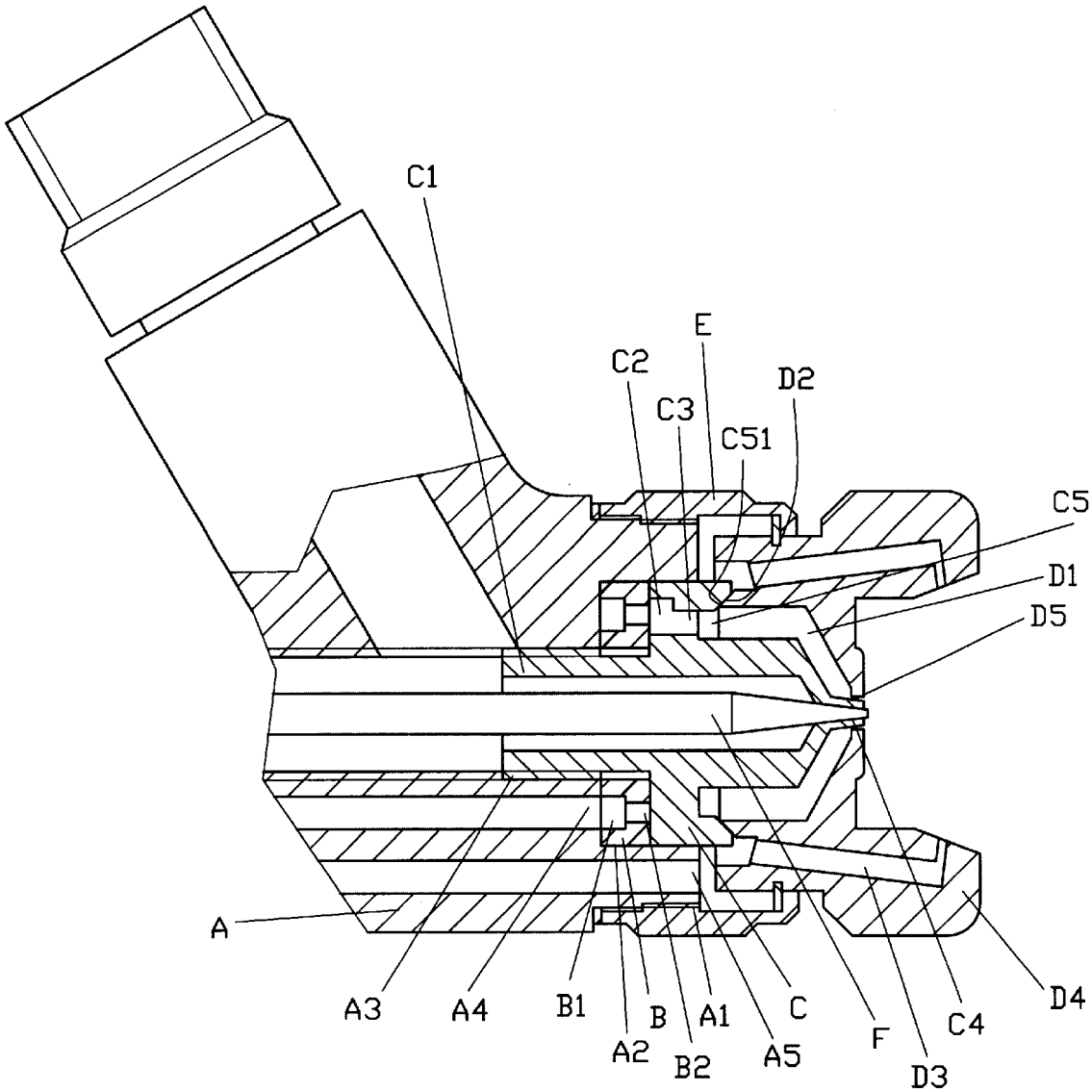
FIG. 4 PRIOR ART
FIG. 4 is a sectional view of an assembly of the prior art.

As illustrated in FIGS. 1 and 2, an improved structure of a spray paint gun head of the present invention comprises a gasket (2), a nozzle (3), a spray head (4) and a nut (5) connected in sequence to the tip of a spray gun (1). A screw hole (11) is provided in the front section of a passage of a regulation shaft (6) extending from the center of the front end of the spray gun (1). The nozzle (3) is engaged to the screw hole (11). An inner recess (12) and an outer recess (13) are formed on the front section of the spray gun (1), wherein, an air outlet (14) and (15) is each respectively provided.

A plurality of slots (21) arranged at a proper distance among one another that circle around the center of the gasket (2) are provided to match the inner and the outer recesses (12) and (13) of the spray gun (1).

A hollow screwed tube (31) is formed in the rear of the nozzle (3) to receive insertion by the gasket (2) so that the rear side of the nozzle (3) is firmly holding against the gasket (2) before being engaged to the screw hole (11) at the center of the front end of the spray gun (1). An inner recess (32) and an outer recess (33) are formed on the rear side of the nozzle (3) to abut to the inner and outer recesses (12) and (13) of the spray gun (1) by aligning with the slots (21) of the gasket (2). A plurality of air ventilating holes (34) are provided in the inner recess (32) of the nozzle (3). A nozzle tip (35) is formed in the front center of the nozzle (3) with a groove (36) around the nozzle tip (35). A push-pull surface (361 ) is formed on the outer surface of the groove (36) and the ventilating holes (34) in the inner recess (32) of the nozzle (3) are connected through the groove (36). A plurality of air outlets (37) provided in the outer recess (33) of the nozzle (3) connecting through the front end of the nozzle (3). Outer threads (38) are provided on the nozzle (3) to be engaged to the nut (5).

The spray head (4) is incorporated to the spray gun (1) with the nut (5). The nut (5) is engaged to the outer threads (38) on the nozzle (3) so that the spray head (4) is fixed to the tip of the spray gun (1) by holding against the front of the nozzle (3). A circular indention (41) is formed inside the spray head (4) and a push-pull wall (42) is formed on the edge of the indention (41) for the push-pull wall (42) to be abutted to the push-pull surface (361) on the groove (36) of the nozzle (3). Air ducts (43) provided on the outer ring around the push-pull wall (42) connect through a pair of air outlet bases (44) provided outside the spray head (4). A spray hole (45) is formed at the center of the front end of the indention (41) to accommodate the nozzle tip (35)

FIG. 2 shows a route of air flow inside the spray head. Wherein, a pressurized air inside the spray gun (1) leaving the outlets (14) and (15) respectively of the inner and the outer recesses (12) and (13) provided at the front surface of the spray gun (1) is buffered by the segregation of the gasket (2). The air then enters through the slots (21) of the gasket (2) into the inner and outer recesses (32) and (33) of the nozzle (3) attached to the gasket (2) to be buffered once again. The air in the inner recess (32) of the nozzle (3) flows to the groove (36) through the ventilating hole (34), and enters into a gap formed by the push-pull surface (361) of the groove (36) abutted with the push-pull wall (42) of the spray head (4) to be diverted into the space defined by the indention (41). Meanwhile, the air in the outer recess (33) of the nozzle (3) flows into the space defined by outer ring around the push-pull wall (42) through the air outlet (37). The air in the indention (41) is jetted from a gap formed between the spray hole (45) and the nozzle tip (35) while the air in the space outside the push-pull wall (42) flows through the air ducts (43) and is delivered by the outer air bases (44) to jointly produce disturbance to the coating and air flow jetted from the nozzle (3) for delivering atomized coating with a wide and even coverage.

As disclosed, an improved structure of a spray paint gun head by taking advantage of the inner and outer recesses (12) and (13) respectively containing the air outlets (14) and (15) provided to the tip of the spray gun (1) to be mutually attached to the gasket (2) provided with the slots (21), and having abutted to the inner and outer recesses (32) and (33) formed in the rear side of the nozzle (3) connected to the tip of the spray gun (1) to form a pressure regulation air port with two segregated spaces; and the outer threads (38) provided on the nozzle (3) to receive the nut (5) for the spray head (4) connected to the nut (5) to mutually secure the nozzle (3) in position by holding against the nozzle (3), eliminates a pressure regulation ring inserted to a recess formed in the front end of the spray gun as observed in the prior art, thus to avoid risk of error resulted from a matching axial hole, i.e., free of affected precision and deformation concerns due to plating and thermal treatment processes. The present invention by helping facilitate manufacturing process of a spray gun head and maintain consistent performance in use of the spray gun head is progressive in correcting defectives found with the prior art.

I claim:

1. A spray paint gun head structure comprising a gasket, a nozzle, a spray head and a nut connected in sequence to the tip of a spray gun, wherein, a nozzle tip being formed in the front center of the nozzle; a groove with its outer surface formed a push-pull surface being provided around the nozzle tip; the spray head being engaged to a nut; the nut being engaged to the nozzle for a circular indention formed inside the spray head to hold against the front of the nozzle; a push-pull wall on the edge of the indention being abutted to the push-pull surface of the groove of the nozzle; air ducts connecting through outer air bases being provided on an outer ring around the push-pull wall of the indention inside the spread head, and a spray hole in the center of the front side of the indention to accommodate insertion of the nozzle tip, characterized by that:

a screw hole being formed in the front section of a passage where a regulation shaft extends from the tip of the spray gun to be engaged to the nozzle; an inner and an outer recess formed on the front surface of the spray gun respectively, each of the recess being respectively provided with an air outlet; a gasket being inserted between the front end of the spray gun and the nozzle; slots surrounding the center of the gasket at proper distance among one another being formed corresponding to the inner and outer recesses of the spray gun; a hollow screwed tube formed in the rear of the nozzle to receive insertion of the gasket before being engaged to the screw hole at the tip of the spray gun; an inner and outer recesses formed in the rear side of the nozzle; air ventilating holes connected through the groove being provided in the inner recess of the nozzle; a plurality of air outlets being provided in the outer recess of the nozzle; the inner and outer recesses of the nozzle abutted to slots of the gasket coupled to the inner and outer recesses of the spray gun to form a pressure regulation air port; and outer threads provided on the nozzle to receive the nut for the spray head to secure the nozzle in position by holding against the nozzle.

* * * * *